US010279498B2

(12) United States Patent
Gambini

(10) Patent No.: US 10,279,498 B2
(45) Date of Patent: May 7, 2019

(54) METHOD FOR SELECTIVELY FEEDING ROLLS OF PAPER COMING OUT OF A LOG SAW UNIT AND RELATIVE LOG SAW UNIT

(71) Applicant: Gambini International S.A., Luxembourg (LU)

(72) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 123 days.

(21) Appl. No.: 15/186,126

(22) Filed: Jun. 17, 2016

(65) Prior Publication Data

US 2017/0361483 A1 Dec. 21, 2017

(51) Int. Cl.
*B26D 5/28* (2006.01)
*B26D 7/06* (2006.01)
(Continued)

(52) U.S. Cl.
CPC ..... *B26D 5/28* (2013.01); *B26D 3/16* (2013.01); *B26D 5/007* (2013.01); *B26D 7/0616* (2013.01);
(Continued)

(58) Field of Classification Search
CPC ..... B26D 5/28; B26D 7/0616; B26D 5/007; B26D 3/16; B26D 7/04; B26D 7/0683;
(Continued)

(56) References Cited

U.S. PATENT DOCUMENTS

2014/0196861 A1* 7/2014 Ota ..... B65H 35/02 162/286
2017/0361484 A1* 12/2017 Pardini ..... B25H 1/08
2018/0162005 A1* 6/2018 Kettula ..... B26D 7/04

FOREIGN PATENT DOCUMENTS

EP 1127791 A1 8/2001
EP 2489486 A1 8/2012
WO 2014/033637 A1 3/2014

OTHER PUBLICATIONS

Ministero dello Sviluppo Economico, Search Report, Apr. 1, 2016.

* cited by examiner

*Primary Examiner* — David J Walczak
(74) *Attorney, Agent, or Firm* — Ice Miller LLP

(57) ABSTRACT

A method for selectively feeding rolls of paper coming out of a log saw unit (10), wherein the log saw unit (10) comprises (n) feeding channels (12) for feeding logs (11) towards a cutting device (13) provided at the outlet with (n) unloading belts (14) in a number equal to the feeding channels (12), comprises a step of generating a stop signal relating to a portion of a packaging unit downstream of the log saw unit (10) further to the detection of accumulation of rolls (11') and/or of stopping of a packaging machine, as well as a step of attributing said stop signal to a feeding channel/sub-group of feeding channels (12) operatively associated with the portion of the packaging unit, called "feeding channels/sub-groups of feeding channels (12) subject to stopping", wherein the method—upon receipt of the stop signal—comprises at least the steps of:

ending the cutting of the log (11) in progress on all of the (n) feeding channels (12) of the log saw unit (10), selectively stopping the forward movement of a new log (11) towards the cutting device (13) just in the feeding channels/sub-groups of feeding channels (12) subject to stopping through the stopping of the forward movement of the carriers (15) of the carrier device (16) of the feeding channels/sub-groups of feeding channels (12) subject to stopping, proceeding without interruption in the operative feeding channels (12), namely those not subject to the stop signal, with the cutting of the logs (11) in succession.

13 Claims, 3 Drawing Sheets

(51) Int. Cl.

| | |
|---|---|
| ***B26D 5/00*** | (2006.01) |
| ***B65B 57/16*** | (2006.01) |
| ***B65B 35/10*** | (2006.01) |
| ***B26D 3/16*** | (2006.01) |
| ***B65B 57/20*** | (2006.01) |

(52) U.S. Cl.
CPC ..... *B65B 35/10* (2013.01); *B65B 57/16* (2013.01); *B65B 57/20* (2013.01); *B65B 2210/02* (2013.01)

(58) Field of Classification Search
CPC .... B26D 1/565; B26D 7/015; B26D 2007/13; B26D 3/161; B26D 7/02; B65B 57/16; B65B 35/10; B65B 57/20; B65B 2210/02; B65H 2701/19; B27B 33/02; B27B 31/006; B27B 27/02
See application file for complete search history.

METHOD FOR SELECTIVELY FEEDING ROLLS OF PAPER COMING OUT OF A LOG SAW UNIT AND RELATIVE LOG SAW UNIT

The present invention refers to a method for selectively feeding rolls of paper coming out of a log saw unit and to a relative log saw unit.

The final part of a "tissue converting" line for producing rolls of toilet or kitchen paper and for their packaging comprises a channel-type log accumulator, arranged downstream of the rewinder, a log saw unit and one or more packaging machines connected to the log saw unit through belt conveyors. The log saw unit comprises a log preloading device on a plurality of feeding channels, which transfer the logs to a cutting device, as well as a plurality of unloading belts arranged side by side to one another, in a number equal to the feeding channels, which transfer the rolls cut by the cutting device towards the belt conveyors. In general, the paths of the log saw unit are equal to four.

In the case in which two packaging machines are provided, for example for simultaneously making two different formats of packs or for increasing the speed of the packaging station, each of them loads the rolls coming from half of the paths of the log saw unit, in general two paths.

The two packaging machines are inevitably subject to machine down times temporally dephased from one another, for example to replace the polyethylene film, or unpredictable in the case of breakdowns.

As a result, also in the case of stop of just one of the two packaging machines the entire log saw unit stops and therefore also the packaging machine that could operate.

In order to partially avoid this problem, currently also deviator belt devices are positioned downstream of the log saw unit, in series with the conveyor belts, to selectively sort the rolls coming out of the log saw unit towards the packaging machines, so as to be able to exclude a temporarily stopped packaging machine, making all of the rolls flow to the other packaging machine.

This solution, however, is not optimal in terms of cost and bulk, since it needs an additional device, the deviator belt, which has a significant bulk in the plant layout.

The purpose of the present invention is to make a method for selectively feeding rolls of paper coming out of a log saw unit and a relative log saw unit that overcome the technical drawbacks indicated above.

Another purpose of the present invention is to make a method for selectively feeding rolls of paper coming out of a log saw unit and a relative log saw unit that allow outgoing rolls to be fed to a single packaging machine.

Another purpose of the present invention is to make a method for selectively feeding rolls of paper coming out of a log saw unit and a relative log saw unit that is particularly simple and functional, with low costs.

These purposes according to the present invention are accomplished by making a method for selectively feeding rolls of paper coming out of a log saw unit and a relative log saw unit as outlined in the independent claims.

Further characteristics are provided in the dependent claims.

The characteristics and advantages of a method for selectively feeding rolls of paper coming out of a log saw unit and of a relative log saw unit according to the present invention will become clearer from the following description, given as an example and not for limiting purposes, referring to the attached schematic drawings, in which.

Figure 1:
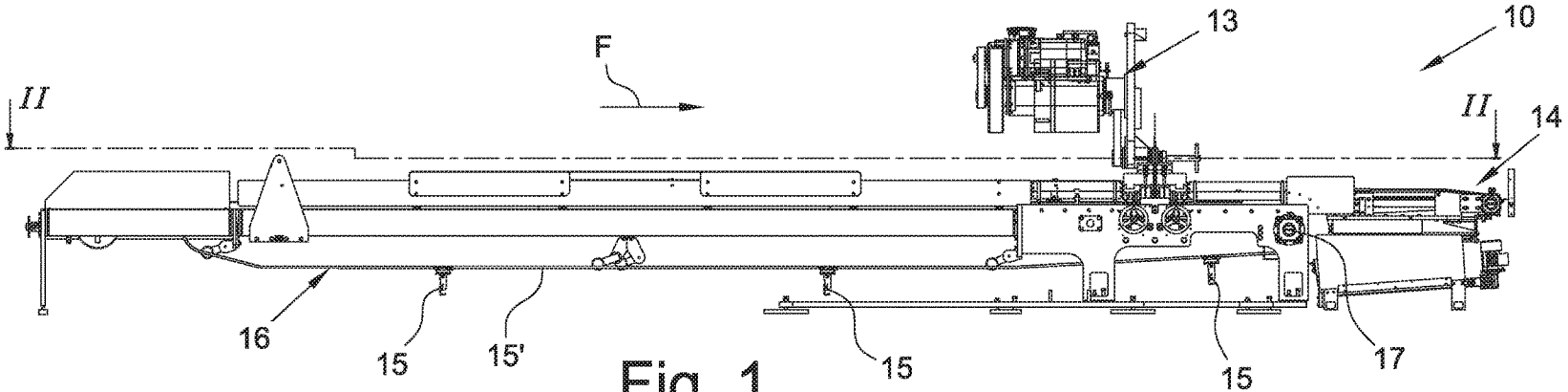
FIG. 1 is a side elevation view of the log saw unit according to the present invention, in which some components have been partially removed, like for example the preloading device, for the sake of greater clarity of representation.
Figure 2:
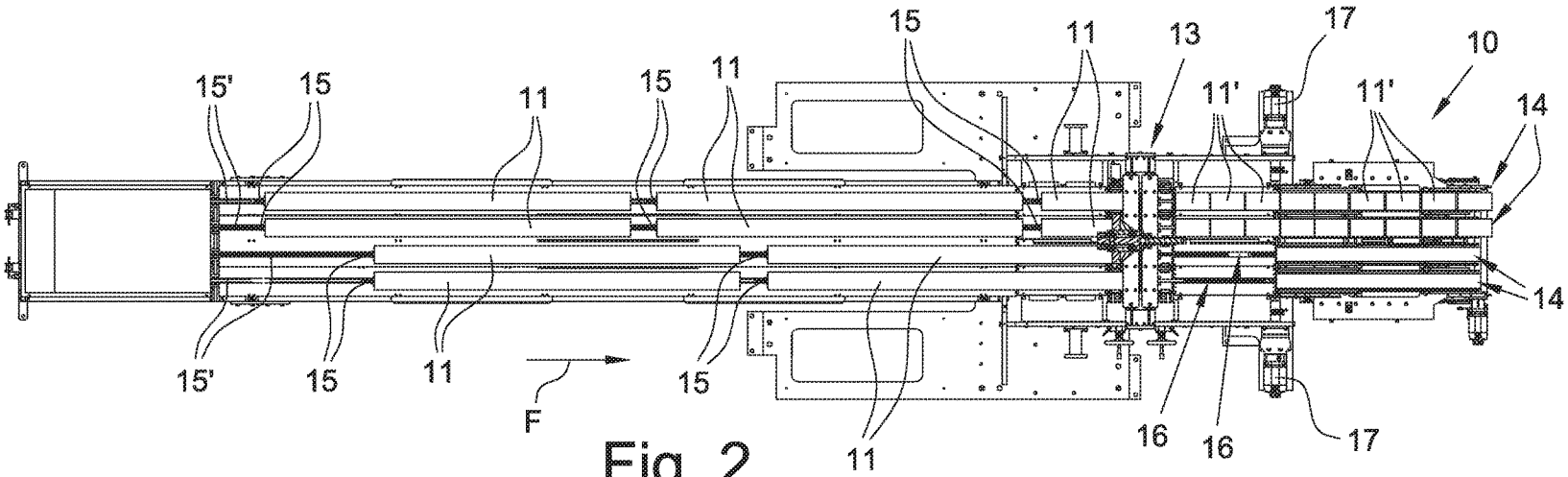
FIG. 2 is a plan view of the log saw unit of FIG. 1, sectioned according to a plane line II-II of FIG. 1.
Figure 3:
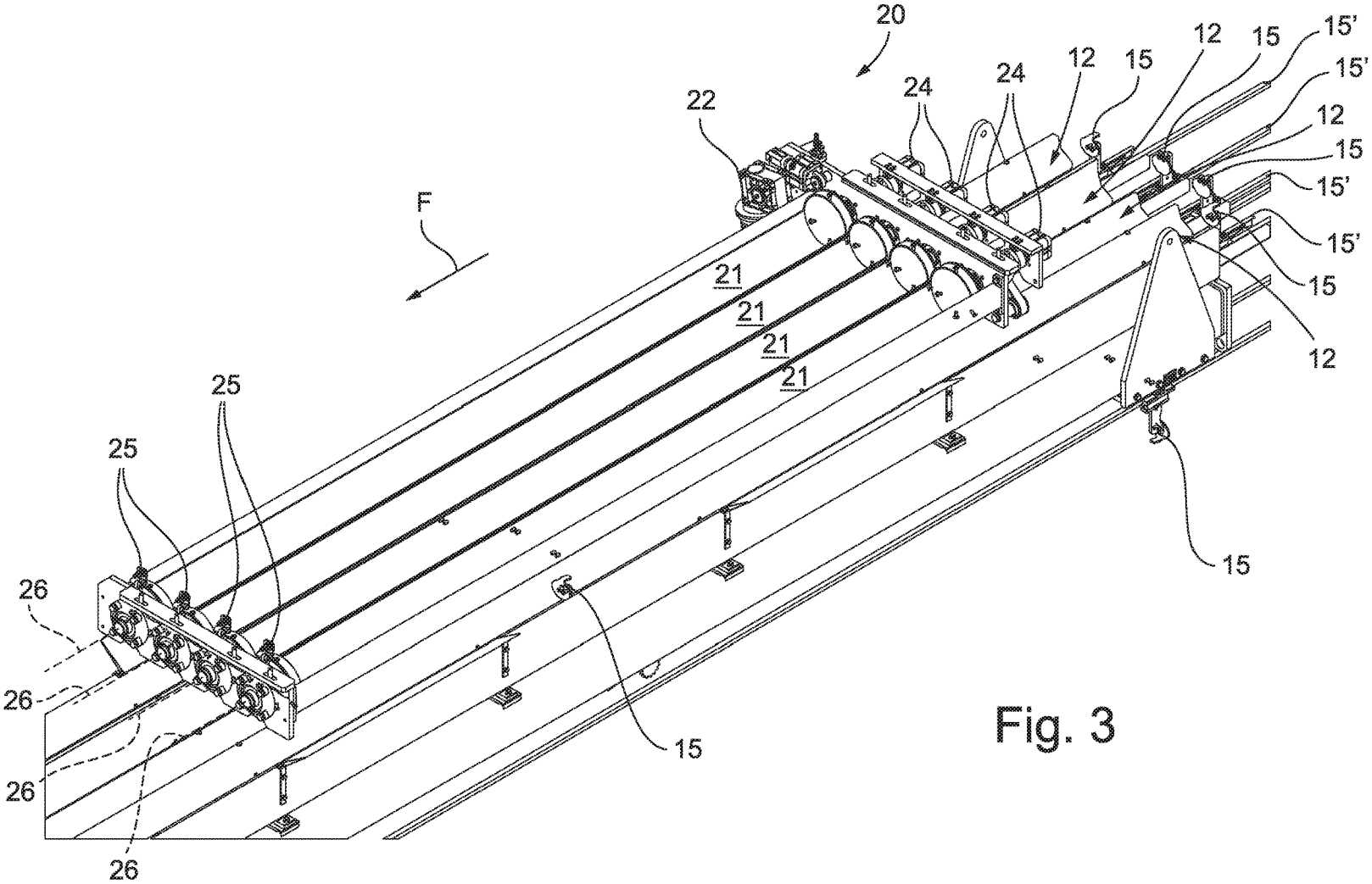
FIG. 3 is a perspective view of an enlarged detail of the preloading device lying above the feeding channels of the log saw unit according to the invention.
Figure 4:
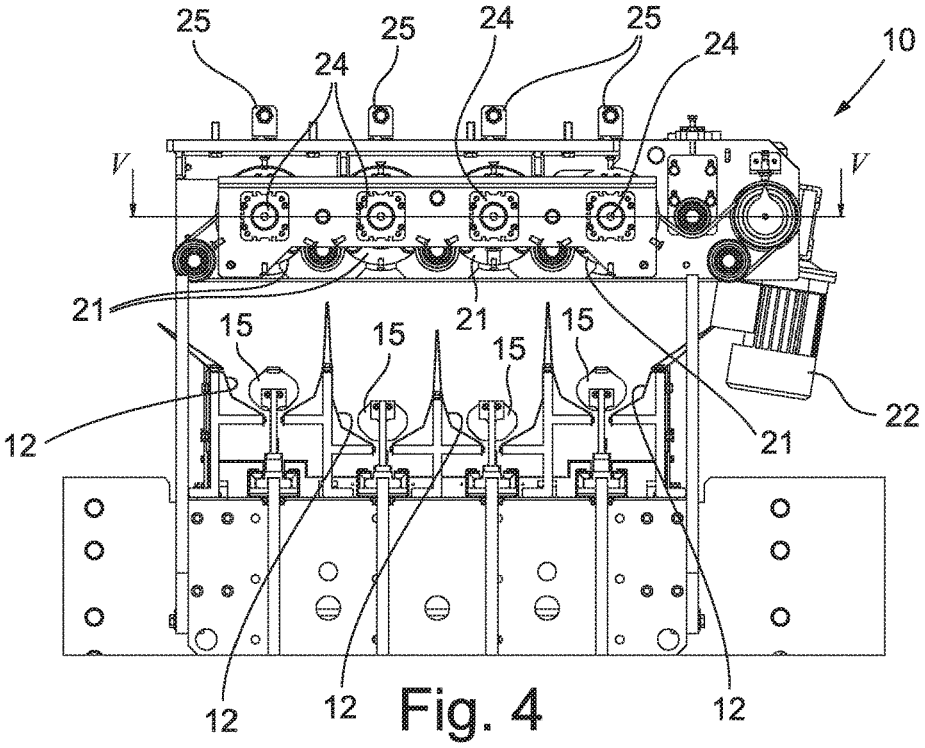
FIG. 4 is a side elevation view showing a detail of the tail side of the log saw unit.
Figure 5:
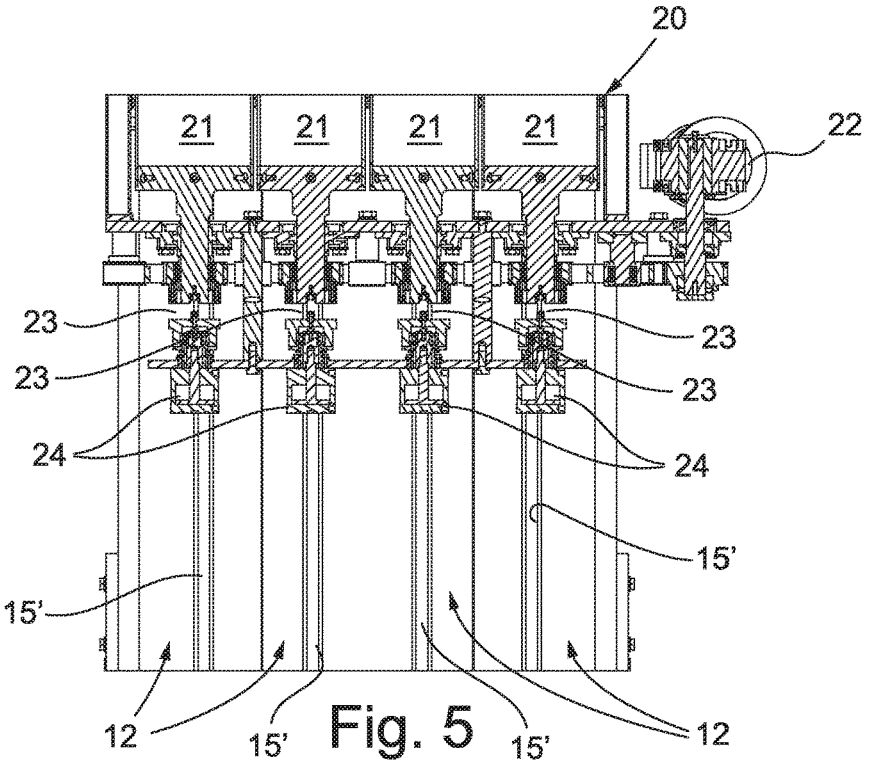
FIG. 5 is a section view made according to the plane line V-V of FIG. 4.

With reference to the figures, a log saw unit is shown, wholly indicated with reference numeral 10, by means of which a method object of the present invention for selectively feeding rolls 11' of paper coming out of the log saw unit 10 is carried out.

In general, the log saw unit comprises a number n of paths equal to four, as shown, but the teachings according to the invention apply without distinction to a log saw unit having a different number of paths, also an odd number.

When combined with a packaging unit, not shown, comprising two packaging machines downstream thereof connected through conveyor belts, the log saw unit in general provides that each one loads the rolls coming from two paths of the log saw unit, but according to the present invention the packaging machines could be in a number greater than two and could load the rolls coming from a different number of paths of the log saw unit.

In the following description, therefore, reference has been generically made to n paths of subgroups of paths and to the relative components of the paths.

The log saw unit 10 for logs 11 of paper comprises a number equal to n of feeding channels 12 for feeding logs, a cutting device 13 for cutting rolls 11' of paper and, downstream of the cutting device 13, a number equal to n unloading belts 14 of rolls 11' equal to the number n of the feeding channels 12.

According to a preferred embodiment, the logs 11, coming from a channel-type accumulator of logs, not shown, are loaded on the feeding channels 12 of the log saw unit 10 through a preloading device 20, arranged in a position directly above a first portion of the n feeding channels 12 with respect to the advancement direction of the logs schematised in the figures with the arrow F.

The unloading belts 14 cooperate with the conveyor belts, not shown, which convey the rolls 11' towards the respective packaging machines operatively associated with them inside the packaging unit. Such conveyor belts for example can be equipped, individually or in subgroups, with photocells, not shown, for detecting the amount of rolls 11' present on them and therefore the accumulation or the end of accumulation conditions of the rolls 11'.

The feeding channels 12 or subgroups of feeding belts 12 each comprise an advancement carrier device 16, equipped with independent actuators 17, preferably made as single servomotors for each feeding channel/sub-group of feeding channels 12.

In the example shown, for instance, two servomotors 17 are shown, each operating on a subgroup of two feeding channels 12.

The advancement carrier device 16 comprises, for each feeding channel 12, a plurality of carriers 15, in general five carriers 15 with stepped continuous movement, distributed along a chain 15' describing a closed loop path with return branch in a lower position with respect to the feeding channels 12.

The log preloading device 20 comprises, according to the invention, a number equal to n cradles 21, each formed by a shell substantially wrapping around the log 11 by an arc of 180°. Each cradle 21 is supported in rotation on opposite end walls at the respective longitudinal axis 26. Each cradle 21 is rotatable by 360° about its own axis 26 in order to unload the log 11 therein contained onto the feeding channel 12 below, in particular the rotation is synchronised with the stepped movement of the advancement carrier device 16 so as to determine the unloading of the log 11 between two successive carriers 15, in the waiting condition when the correct position of the carriers 15 is detected in a predetermined release position of the logs 11.

According to a first simplified embodiment, all of the cradles 21 provide for a single motor that carries out the rotation of all of the cradles 21 simultaneously.

According to a preferred embodiment of the present invention, each of the cradles 21 or subgroups of cradles 21 are independently set in rotation, for example carried out through a unique motor 22, selectively placed in engagement or disengagement with each of the cradles 21 through a coupling 23 actuated by a relative piston 24 that can be controlled through solenoid valves.

According to a further embodiment, not shown, the cradles 21 are set in rotation by single motors, or by a motor for each pair of cradles 21.

In general, the rotation of the cradles 21 is in any case "called" by the carriers 15 in the feeding channels 12 below reaching a predetermined release position, to ensure the synchronism with them.

Furthermore each cradle 21 is preferably provided with a photocell 25 for detecting the presence of the log 11.

The log saw unit 10 according to the invention comprises a control unit for processing a stop signal relative to a portion of the packaging unit downstream of the log saw unit, for example relative to a packaging machine, generated further to a detection of accumulation of rolls 11' and/or of stop of a packaging machine.

The control unit attributes such a stop signal to a feeding channel/sub-group of feeding channels 12 operatively associated with the portion of the packaging unit in the stopping condition, called "feeding channels/sub-groups of feeding channels 12 subject to stopping".

The method for selectively feeding rolls of paper coming out of a log saw unit according to the invention comprises a step of generating a stop signal relative to a portion of the packaging unit downstream of the log saw unit following a detection of accumulation of rolls and/or of stopping of a packaging machine.

The stop signal, in a second step of the method, is attributed to a feeding channel/sub-group of feeding channels 12 operatively associated with the portion of the packaging unit in the stopping condition, called "feeding channels/sub-groups of feeding channels subject to stopping".

Upon receipt of the stop signal, according to the method object of the invention, at least the following steps are carried out:

ending the cutting of the log 11 in progress on all of the n feeding channels 12 of the log saw unit 10, selectively stopping the forward movement of a new log towards the cutting device 13 just in the feeding channels/sub-groups of feeding channels 12 subject to stopping through the stop of the forward movement of the carrier device 16 of said feeding channels/sub-groups of feeding channels 12 subject to stopping, as schematised in FIG. 1, proceeding without interruption in the operative feeding channels 12, namely not subject to the stop signal, with the cutting of the logs 11 in succession during the entire period of presence of the stop signal.

According to the invention, the stop signal also controls the selective interruption of the feeding of the logs from the channel-type accumulator to the cradles/sub-groups of cradles 21 that are operatively associated with the packaging unit portion subject to stopping. Such cradles/sub-groups of cradles 21, in fact, according to the simplified single-control embodiment must remain empty and according to the preferred independent control embodiment are already occupied by a log 11.

Upon receipt of a stop signal and of the consequent control of the feeding channels/sub-groups of feeding channels 12 subject to stopping carried out by the control unit, the cradles/sub-groups of cradles 21 cooperating with them, anyway are able to unload the logs 11 only if the carriers 15 reach the predetermined unloading position.

In the case in which the cradles/sub-groups of cradles 21 are not equipped with independent control, instead with a unique motor that causes the simultaneous rotation of all of the cradles 21, according to the simplified configuration, if they have already been fed with the log 11 by the accumulator before the stop signal receipt, the method according to the invention, after the step of ending the cutting of the log 11 in progress on all of the n feeding channels 12 of the log saw unit 10, provides for an additional step of performing the cutting of a further log on all of the n feeding channels 12 to allow the unloading of the log 11 already contained in the cradles/sub-groups of cradles 21 operatively associated with the feeding channels/sub-groups of feeding channels 12 subject to stopping. Differently, on occasion of the first rotation of all of the cradles 21, controlled by the carriers 15 of the operative feeding channels/sub-groups of feeding channels 12 reaching the predetermined release position, in the feeding channels/sub-groups of feeding channels 12 subject to stopping the logs 11 contained in the cradles 21 would at least partially fall onto the logs 11 already present in the feeding channels.

Differently, if the cradles 21 are set in rotation independently according to the preferred embodiment, the carriers 15 of the feeding channels/sub-groups of feeding channels 12 subject to stopping can be stopped immediately at the end of the cutting of the log in progress, thus generating the minimum amount of rolls 11' possible on the conveyors downstream of the log saw unit 10, and the relative cradles/sub-groups of cradles 21 will be prevented from unloading as soon as the carriers 15 have been stopped.

Upon resolution of the problem in the portion of the packaging unit that caused the stop signal, according to the method object of the present invention an end stop signal is generated relative to the portion of the packaging unit downstream of the log saw unit, object of the prior stopping and for which meanwhile a detection of elimination of rolls accumulation and/or of a packaging machine end stop is carried out.

According to an embodiment that is not shown, if the packaging unit comprises three packaging machines, two of which are object of stop signal, according to the invention the end of stop signal could also concern only one of the two packaging machines in the stop condition.

According to the method object of the invention, the end stop signal is attributed by the control unit of the log saw unit 10 to a feeding channel/sub-group of feeding channels 12 operatively associated with the portion of the packaging unit for which the stop reason has been solved, called "feeding channels/sub-groups of feeding channels 12 subject to the end of stop".

Upon receipt of the end stop signal, according to the method object of the invention, in the log saw unit 10 the following steps are carried out:

ending the cutting of the log 11 in progress in the operative feeding channels 12, then selectively starting the forward movement of a new log 11 towards the cutting device 13 only in the feeding channels/sub-groups of feeding channels 12 subject to the end of stop through the start of the forward movement of the carrier device 16 of the feeding channels/sub-groups of feeding channels 12 subject to the end of stop, in which the start of the forward movement of the advancement carrier device 16 is phased in a synchronous manner with the forward movement of the carrier device 16 of the other operative feeding channels 12, proceeding without interruption in the operative feeding channels 12, namely those not subject to the stop signal, with the cutting of the logs 11 in succession, thus going back to a complete operativity situation.

In fact, the restart of the advancement carrier device 16 of the feeding channels/sub-groups of feeding channels 12 subject to the end of stop automatically determines, also in the case of independently controlled cradles/sub-groups of cradles 21, the unloading of the log 11 when the carriers 15 go to the predetermined release position.

According to the invention, the end stop signal also controls the reactivation of the selective feeding of the logs from the channel-type accumulator to the cradles/sub-groups of cradles 21 operatively associated with the portion of packaging unit subject to the end of stop.

In light of the above, the cutting of the logs 11 in the feeding channels 12 not subject to stop proceeds unaltered, while the cutting of the logs 11 in the feeding channels 12 subject to stop proceeds at least until the complete cutting at least of the log 11 being processed, not being able to stop the cutting device 13 that simultaneously cuts the logs 11 present on all of the n feeding channels 12, and it is then stopped, at the maximum after the cutting of a successive log 11 for needs of unloading of the preloading device 20, until the problem has been fixed, keeping a log wait in each feeding channel 12, in a position ready for the cutting to start. Based on the length of the logs 11 being processed, which can be of different formats, there can be more logs 11 in succession waiting in the feeding channels 12 subject to stopping. For example FIG. 1 shows two feeding channels 12 subject to stopping and two operative feeding channels 12. In the feeding channels 12 subject to stopping, in addition to the log 11 waiting in position ready for the cutting to start, there is a second log 11 in the queue. In each of the operative feeding channels 12, the conclusive cutting step of a log 11 in rolls 11' is in progress and two logs 11 are arranged in succession in queued to the log 11 being cut. In the condition shown, the last queued log in the operative feeding channels 12 is in the release position by the preloading device 20, above the feeding channels 12 and not shown for reasons of clarity of representation.

Upon receipt of the end stop signal, the first log 11 waiting in the feeding channels 12 previously stopped is sent for cutting in a synchronous manner with the first whole log sent for cutting in the feeding channels 12 that have not been stopped.

According to the invention, the detection of accumulation of rolls 11' and the detection of the end of accumulation of rolls 11' on the conveyor belts downstream of the unloading belts 14 of the log saw unit 10 is carried out for example through photocells or other means that detect the amount of rolls 11' present on the conveying lines downstream of the log saw unit.

The method for selectively feeding rolls of paper coming out of a log saw unit and the relative log saw unit object of the present invention have the advantage to allow minimising the length of the conveyors arranged downstream of the log saw unit capable of overcoming the machine down times of one of the two packagers through a high-reactive system.

In fact, by only acting on the preloading device of the logs on the feeding channels to prevent the unloading of the logs on the feeding channels being stopped, instead of also stopping the carriers like in the present invention, would require to arrange downstream of the log saw unit conveyor belts suitable for receiving the equivalent of the rolls generated by the cutting of two successive logs. If the stop signal arrives immediately after the preloading device has unloaded the logs onto the feeding channels, there is no way to avoid the rolls derived from the cutting of the log in progress and the one immediately after from ending up on the conveyor belts to the packager. This could still be a reason for stopping the plant especially in situations of short belts if the plant layout provides for little distance between log saw unit and packaging machine.

The method for selectively feeding rolls of paper coming out of a log saw unit and the relative log saw unit thus conceived can undergo numerous modifications and variants, all of which are covered by the invention; moreover, all of the details can be replaced by technically equivalent elements. In practice, the materials used, as well as the sizes, can be whatever according to the technical needs.

The invention claimed is:

1. Method for selectively feeding rolls of paper coming out of a log saw unit, wherein said log saw unit comprises (n) feeding channels for feeding logs towards a cutting device, wherein said method comprises the steps of:

generating a stop signal relating to a portion of a packaging unit downstream of the log saw unit upon detection of an accumulation of rolls or of stop of the packaging unit;

attributing said stop signal to at least one feeding channel subject to stopping and operatively associated with said portion of the packaging unit;

after attributing said stop signal, ending the cutting of the log in progress on all of said (n) feeding channels of the log saw unit;

after attributing said stop signal, selectively stopping the forward movement of a new log towards the cutting device just in the at least one feeding channel subject to stopping through the stopping of the forward movement of carriers of a carrier device of said at least one feeding channel subject to stopping; and after attributing said stop signal, proceeding without interruption with the cutting of the logs in succession in operative feeding channels not in the at least one feeding channel subject to stopping.

2. Method according to claim 1, wherein said feeding channels said log saw unit are fed by a preloading device for preloading logs, comprising (n) cradles set in rotation once the carriers of the feeding channels have reached a predetermined release position.

3. Method according to claim 2, wherein said cradles are set in rotation simultaneously with respect to each other once the release position has been reached by the carriers of the corresponding operative feeding channels not in the feeding channels/sub-groups of feeding channels subject to stopping.

4. Method according to claim 2, wherein said cradles are set in rotation independently from each other once the release position has been reached by the carriers of the corresponding operative feeding channels not in the feeding channels/sub-groups of feeding channels subject to stopping.

5. Method according to claim 2, wherein the stop signal also controls the selective interruption of the feeding of logs (11) to the cradles/sub-groups of cradles (21) of the packaging unit operatively associated with the at least one feeding channel subject to stopping.

6. Method according to claim 5, further comprising, after the step of ending the cutting of the log in progress on all of the (n) feeding channels of the log saw unit, performing the cutting of a further log on all of the (n) feeding channels in order to allow the unloading of the log already contained in the cradles operatively associated with the at least one feeding channel subject to stopping.

7. Method according to claim 1, further comprising the steps of:

generating an end stop signal relating to a portion of the packaging unit downstream of the log saw unit upon detection of elimination of accumulation of rolls or of the end of the stop of the packaging unit;

attributing said end stop signal to at least one feeding channel subject to the end of the stop and operatively associated with said portion of the packaging unit;

upon receipt of the end stop signal, ending the cutting of the log in progress in the operative feeding channels;

then selectively restarting the forward movement of a new log towards the cutting device only in the at least one feeding channel subject to the end of the stop through the starting of the forward movement of the carrier device of said at least one feeding channels subject to the end of the stop, wherein the starting of the forward movement of the carrier device is phased in a synchronous manner with the forward movement of the carrier device of the operative feeding channels; and proceeding without interruption in the operative feeding channels with the cutting of the logs in succession.

8. Method according to claim 1, wherein said detection of accumulation of rolls and said detection of elimination of accumulation of rolls is performed through photocells that detect the amount of rolls present on the conveying lines downstream of the log saw unit.

9. Log saw unit for logs of paper comprising (n) feeding channels for feeding logs to a cutting device for cutting rolls of paper, the cutting device provided with (n) unloading belts arranged downstream of the cutting device and suitable for transferring rolls towards a packaging unit, and further comprising a control unit for processing a stop signal relating to a portion of the packaging unit downstream of the log saw unit generated upon detection of accumulation of rolls or of a stop of the packaging unit and for attributing said stop signal to at least one feeding channel subject to stopping and operatively associated with said portion of the packaging unit, wherein said at least one feeding channel subject to stopping comprise an advancement carrier device equipped with actuators that are independent from each other and selectively controllable by said control unit.

10. Log saw unit according to claim 9, further comprising a log preloading device constructed and arranged for receiving logs coming from a channel-type accumulator, wherein said preloading device comprises (n) cradles, each suitable for receiving a log, each of said cradles being supported in rotation on opposite end walls on a longitudinal axis in order to allow a rotation of 360° suitable for unloading the log contained therein onto a feeding channel below the cradle.

11. Log saw unit according to claim 10, wherein each of said (n) cradles have an independent control.

12. Log saw unit according to claim 11, wherein said independent control comprises a single motor arranged to selectively engage or disengage one of the (n) cradles through a coupling actuated by a relative piston that is controllable through solenoid valves.

13. Log saw unit according to claim 9, wherein said actuators comprise single servomotors for each of the at least one feeding channel subject to stopping.

* * * * *